US005615441A

United States Patent [19]

Savini

[11] Patent Number: 5,615,441

[45] Date of Patent: Apr. 1, 1997

[54] LOTTERY TICKET SCRAPER AND BRUSH DEVICE

[76] Inventor: Daniel J. Savini, 50L Glen Keith Rd., Glen Cove, N.Y. 11542

[21] Appl. No.: 655,211

[22] Filed: Jun. 5, 1996

[51] Int. Cl.[6] ..... A47L 13/02; G09F 7/00; G09F 3/20

[52] U.S. Cl. ..... 15/111; 15/236.01; 15/236.07; 40/314; 40/649; 40/661; D3/207; D3/208; D4/118; D32/42

[58] Field of Search ..... 15/111, 236.01, 15/236.05, 236.07, 236.08, 236.09; 40/314, 649, 661, 1.6; D3/207, 208, 209, 210, 211, 212; D4/116, 118; D11/3, 4

[56] References Cited

U.S. PATENT DOCUMENTS

| | | | |
|---|---|---|---|
| D. 150,655 | 8/1948 | Reinecke | D11/4 |
| D. 347,255 | 5/1994 | Kerr | D4/118 |
| D. 353,239 | 12/1994 | Brisloe | D3/210 |
| D. 367,343 | 2/1996 | Wise | D3/208 |
| 3,604,232 | 9/1971 | Mosher | D3/207 |
| 4,177,587 | 12/1979 | Dorsen | 40/314 |
| 4,757,567 | 7/1988 | Booker | 15/111 |
| 4,777,693 | 10/1988 | Diba | 15/111 |
| 5,022,650 | 6/1991 | Madock . | |
| 5,062,672 | 11/1991 | Harris . | |
| 5,230,117 | 7/1993 | Johnson et al. . | |
| 5,507,492 | 4/1996 | Adell | D3/208 |

*Primary Examiner*—David Scherbel
*Assistant Examiner*—Randall E. Chin
*Attorney, Agent, or Firm*—Michael I. Kroll

[57] ABSTRACT

A scraper and brush device (10) for a lottery ticket (12) comprising a body member (14). A component (16) on the body member (14) is for scraping off a coating (18) on the lottery ticket (12). An element (20) on the body member (14) is for cleaning the lottery ticket (12). The scraped coating (18) will be removed to expose data (22) printed on the lottery ticket (12), in which the data (22) can now be read by a person (24).

13 Claims, 3 Drawing Sheets

LOTTERY TICKET SCRAPER AND BRUSH DEVICE

BACKGROUND OF THE INVENTION

1. Field of the Invention

The instant invention relates generally to cleaning tools and more specifically it relates to a lottery ticket scraper and brush device.

2. Description of the Prior Art

Numerous cleaning tools have been provided in prior art. For example, U.S. Pat. No. 5,022,650 to Madock; U.S. Pat. No. 5,062,672 to Harris and U.S. Pat. No. 5,230,117 to Johnson et al. all are illustrative of such prior art. While these units may be suitable for the particular purpose to which they address, they would not be as suitable for the purposes of the present invention as heretofore described.

MADOCK, MICHAEL F.

GOLF TOOL

U.S. Pat. No. 5,022,650

A golf tool includes a main body, a pair of tines disposed on a first end of the main body fixed with respect to the main body and a series of bristles forming a brush fixed on a second end of the main body opposite the first end. In addition, a ball marker may be removably mounted on the main body. The golf tool is compact and lightweight and is convenient to use during play.

HARRIS, JAMES I.

COPY MACHINE REMOVER OF PAPER CLIPS AND STAPLES

U.S. Pat. No. 5,062,672

A copy machine paper clip and staple retrieval device with a rigid longitudinally extending elongated member has a cross sectional area extending transversely across its longitudinal axis with its cross sectional area diminished toward its distal end. A permanent magnet has a transverse cross sectional area smaller than the member's distal end's cross sectional area. A cap member of compressible composition with an inner space has the permanent magnet received and seated therein after insertion through the cap's open upper end. The open end size has the distal end received therein with the compressible composition compressibly secured onto the distal end. The cap member has a small cap cross sectional area. The bottom end has an outer surface substantially columnar with a blunt outer bottom surface having rounded edges. The cap member is columnar in shape. The cap's top open end has an inner circular surface. The elongated member at its diminished cross sectional area is substantially conical in shape toward and at the distal end. The cap member at the inner circular surface is compressibly mounted on the conically shaped distal end. A brush mounted on the distal end with bristles positioned in a fan shape extends substantially radially outwardly from the distal end in a direction away from the proximal end. The cap member is embedded within the bristles.

JOHNSON, RONALD W.

JOHNSON, ROBERT N.

GOLF SHOE AND GOLF CLUB CLEANING DEVICE

U.S. Pat. No. 5,230,117

A golf shoe and golf club cleaning device particularly adapted for attachment to a golf bag or other convenient surface. The device includes a brush handle having soft bristles embedded in one face thereof and stiff bronze bristles embedded in an end wall that extends out of the general longitudinal extent of the handle at an angle thereto. The handle is tethered to a golf bag by a spring loaded cable that retracts into a casing and the cable is removably attached to a golf bag. By this arrangement, the brush is securely fastened to the golf bag or other convenient surface during normal play.

SUMMARY OF THE INVENTION

A primary object of the present invention is to provide a lottery ticket scraper and brush device that will overcome the shortcomings of the prior art devices.

Another object is to provide a lottery ticket scraper and brush device that is a useful tool for scraping and brushing lottery tickets, so that a person can check out the lottery tickets to see if the person wins.

An additional object is to provide a lottery ticket scraper and brush device that contains a zodiac sign good luck medal, which can be worn on a key chain, necklace or bracelet, to make a person feel lucky.

A further object is to provide a lottery ticket scraper and brush device that is simple and easy to use.

A still further object is to provide a lottery ticket scraper and brush device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
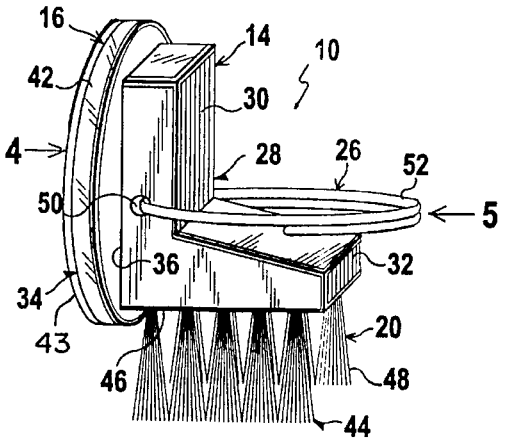
FIG. 1 is a perspective view of the instant invention.
Figure 2:
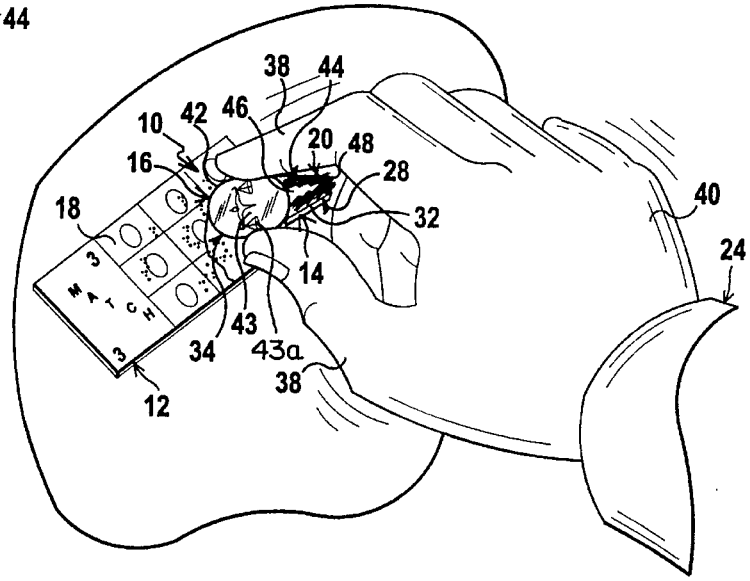
FIG. 2 is a perspective view, showing a scraping component of the instant invention being used to scrape off a lottery ticket.
Figure 3:
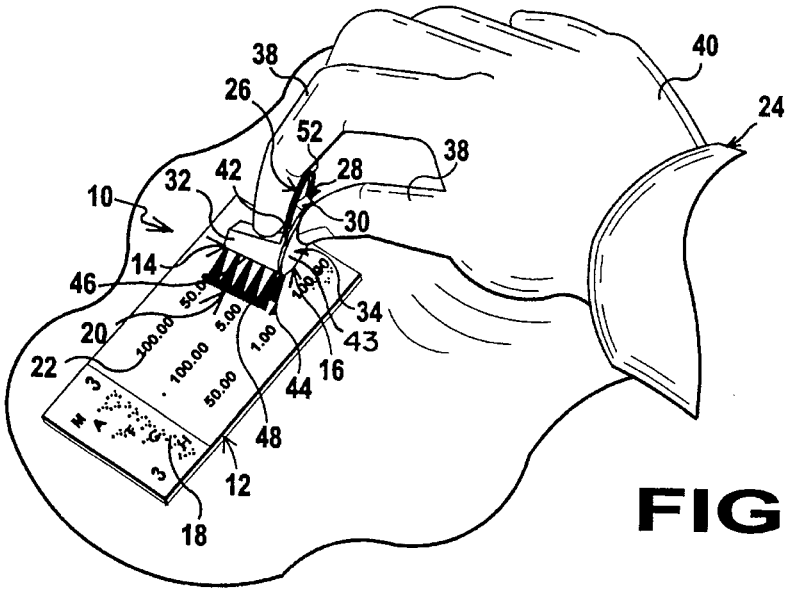
FIG. 3 is a perspective view, showing a cleaning element of the instant invention being used to clean off the lottery ticket.
Figure 4:
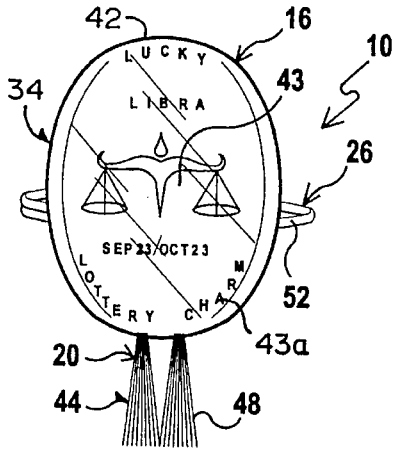
FIG. 4 is a front view taken in the direction of arrow 4 in FIG. 1.

Turning now descriptively to the drawings, in which similar reference characters denote similar elements throughout the several views, FIGS. 1 through 7 illustrate a scraper and brush device 10 for a lottery ticket 12, comprising a body member 14. A component 16 on the body member 14 is for scraping off a coating 18 on the lottery ticket 12. An element 20 on the body member 14, is for cleaning the lottery ticket 12. The scraped coating 18 will be removed to expose data 22 printed on the lottery ticket 12, in which the data 22 can now be read by a person 24. A structure 26 on the body member 14 is for carrying the device 10 on the person 24.

Figure 8A:
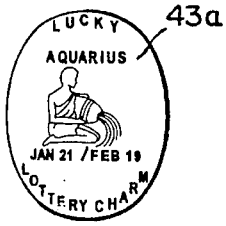
FIGS. 8A to 8O are front views, showing different types of good luck medals.
Figure 8B:
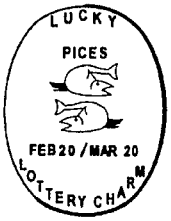
Figure 8C:
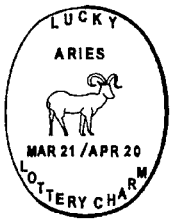
Figure 8D:
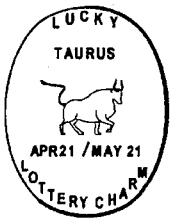
Figure 8E:
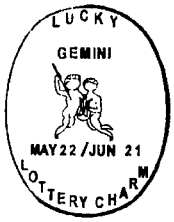
Figure 8F:
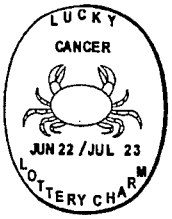
Figure 8G:
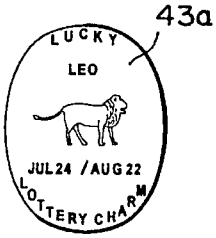
Figure 8H:
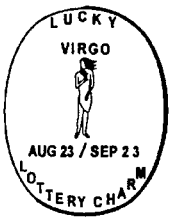
Figure 8I:
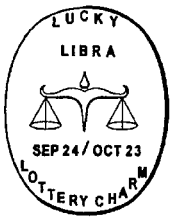
Figure 8J:
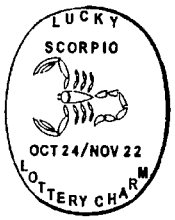
Figure 8K:
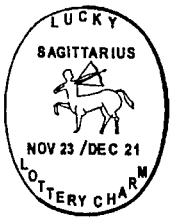
Figure 8L:
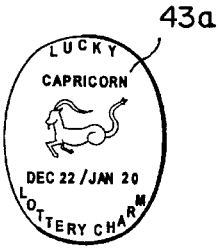
Figure 8M:
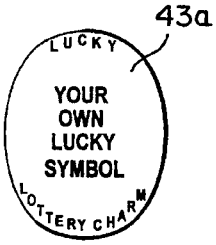
Figure 8N:
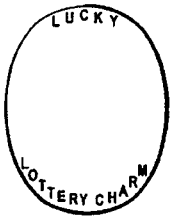
Figure 8O:
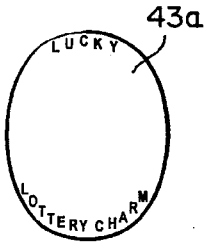
Figure 9:
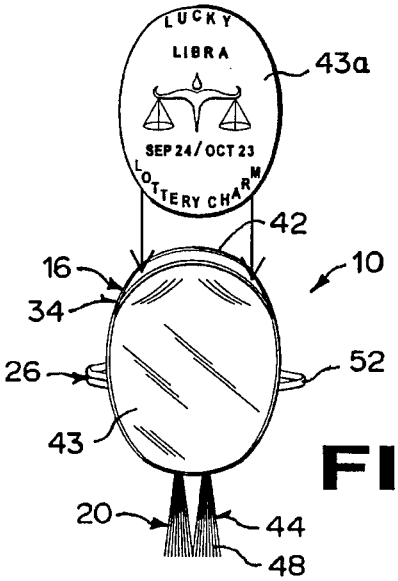
FIG. 9 is a front view similar to FIG. 4, showing one good luck medal ready to be inserted into the transparent display pocket on the disk of the cleaning element.

The body member 14 is a generally L-shaped housing 28 having a first leg 30 and a second leg 32 at a right angle to the first leg 30. The scraping component 16 is a disk 34 affixed to an outer surface 36 of the first leg 30 of the housing 28. The disk 34 can be grasped by fingers 38 of a hand 40 of the person 24 and an edge 42 of the disk 34 used to scrape off the coating 18 on the lottery ticket 12 (see FIG. 2). A transparent display pocket 43 is affixed to the disk 34. A good luck medal 43a can be inserted into the transparent display pocket 43, so as to make the person feel lucky. The good luck medal 43*a* can be zodiac signs as shown in FIGS. 8A to 8L, your own lucky symbol as shown in FIG. 8M, or blanks, as shown in FIGS. 8N and 8O.

The cleaning element 20 is a brush 44 fixed to an outer surface 46 of the second leg 32 of the housing 28. The first leg 30 with the scraping component 16 can be grasped by the fingers 38 of the hand 40 of the person 24 and the brush 44 used to remove the scraped coating 18 off the lottery ticket 12 (see FIG. 3). The brush 44 consists of two rows of bristles 48 arranged in groups and embedded into the outer surface 46 of the second leg 32 of the housing 28.

Figure 6:
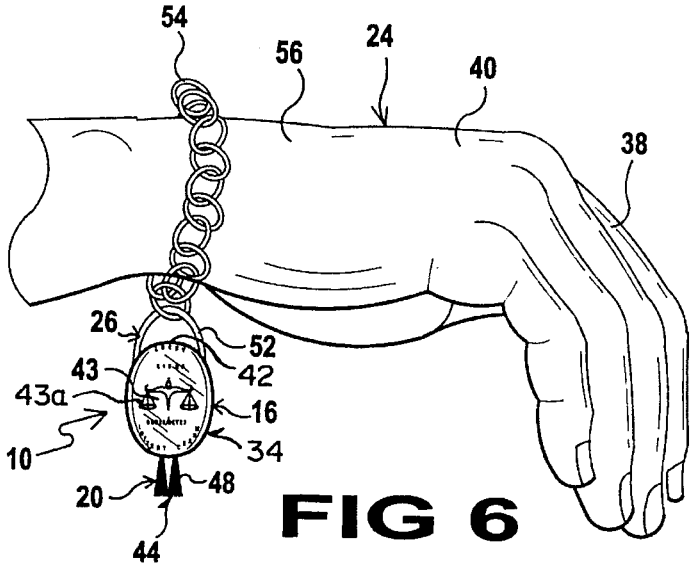
FIG. 6 is an elevational view, showing the instant invention worn with a bracelet on a hand of a person.
Figure 5:
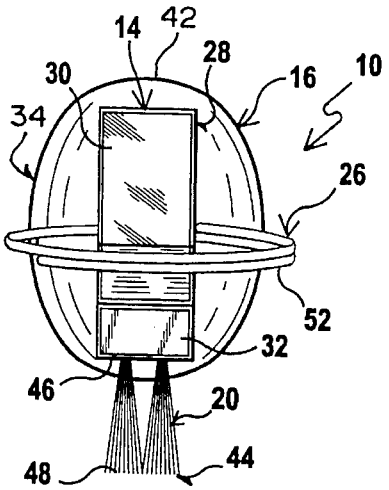
FIG. 5 is a rear view taken in the direction of arrow 5 in FIG. 1.

The carrying structure 26 comprises the body member 14 having an aperture 50 therethrough. A slip ring 52 extends through the aperture in the body member 14. As shown in FIG. 6, a bracelet 54 is connected to the slip ring 52, so that the bracelet 54 with the device 10 can be worn about a wrist 56 on the hand 40 of the person 24.

Figure 7:
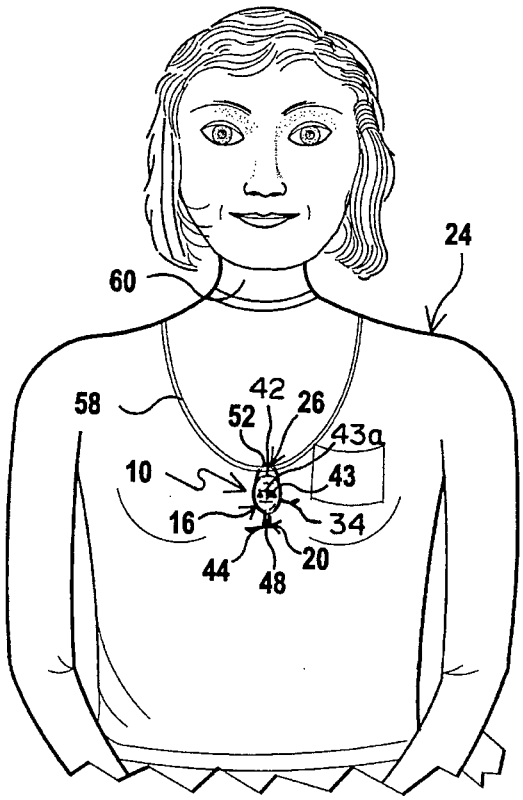
FIG. 7 is an elevational view, showing the instant invention worn with a necklace about a neck of a person.

In FIG. 7, a necklace 58 is connected to the slip ring 52, so that the necklace 58 with the device 10 can be worn about a neck 60 of the person 24. The slip ring 52 can also be connected to a key chain or any other line, not shown in the drawings, so that the device 10 can be carried by the person 24.

OPERATION OF THE INVENTION

To use the scrapper and brush device 10, the following steps should be taken:

1. Insert one of the good luck medals 43*a* into the transparent display pocket 43.
2. Place the lottery ticket 12 upon a flat surface, such as a table top.
3. Grasp opposite sides of the disk 34 by the fingers 38 on the hand 40.
4. Rub the edge 42 of the disk 34 against the coating 18, so as to scrape off the coating 18 and expose the data 22 on the lottery ticket 12.
5. Hold the first leg 30 and the scraping component 16 by the fingers 38 on the hand 40.
6. Move the brush 44 across the lottery ticket 12 to remove the scraped coating 18 off the lottery ticket 12.
7. Read the data 22 on the lottery ticket 12 and if the person 24 is lucky by choosing the right good luck medal 43*a*, that person 24 will win the game played on the lottery ticket 12.

LIST OF REFERENCE NUMBERS

10 scraper and brush device
12 lottery ticket
14 body member of 10
16 scraping component of 10 on 14
18 coating on 12
20 cleaning element of 10 on 14
22 data on 12
24 person
26 carrying structure of 10 on 14
28 generally L-shaped housing for 14
30 first leg of 28
32 second leg of 28
34 disk of 16
36 outer surface of 30
38 finger of 40
40 hand of 24
42 edge of 34
43 transparent display pocket on 34
43*a* a good luck medal
44 brush of 20
46 outer surface of 32
48 bristles of 44
50 aperture in 14
52 slip ring of 26
54 bracelet of 26
56 wrist on 40
58 necklace of 26
60 neck of 24

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A scraper and brush device for a lottery ticket comprising:

a) a body member;

b) means on said body member, for scraping off a coating on the lottery ticket; and c) means on said body member, for cleaning the lottery ticket, so that the scraped coating will be removed to expose data printed on the lottery ticket, in which the data can now be read by a person d) means on said body member, for carrying said device on the person; wherein said body member is generally L-shaped housing having a first leg and a second leg at a right angle to said first leg and further wherein said scraping means is a disk affixed to an outer surface of said first leg of said housing, so that said disk can be grapsed by fingers on a hand of the person and an edge of said disk used to scrape off the coating on the lottery ticket.

2. A scraper and brush device for a lottery ticket as recited in claim 1, further including:

a) a transparent display pocket affixed to said disk; and b) a good luck medal, which can be inserted into said transparent display pocket, so as to make the person feel lucky.

3. A scraper and brush device for a lottery ticket as recited in claim 1, wherein said cleaning means is a brush fixed to an outer surface of said second leg of said housing, so that said first leg with said scraping means can be grasped by fingers of a hand of the person and said brush used to remove the scraped coating off the lottery ticket.

4. A scraper and brush device for a lottery ticket as recited in claim 3, wherein said brush includes two rows of bristles arranged in groups and embedded into the outer surface of said second leg of said housing.

5. A scraper and brush device for a lottery ticket as recited in claim 1, wherein said carrying means includes:

a) said body member having an aperture therethrough; and b) a slip ring extending through said aperture in said body member.

6. A scraper and brush device for a lottery ticket as recited in claim 5, wherein said carrying means further includes a bracelet connected to said slip ring, so that said bracelet with said device can be worn about a wrist on a hand of the person.

7. A scraper and brush device for a lottery ticket as recited in claim 5, wherein said carrying means further includes a necklace connected to said slip ring, so that said necklace with said device can be worn about a neck of the person.

8. A scraper and brush device for a lottery ticket comprising:

a ) a body member;

b) means on said body member, for scraping off a coating on the lottery ticket;

c) means on said body member, for cleaning the lottery ticket, so that the scraped coating will be removed to expose data printed on the lottery ticket, in which the data can now be read by a person;

d) means on said body member, for carrying said device on the person wherein said body member is a generally L-shaped housing having a first leg and a second leg at a right angle to said first leg and further wherein said scraping means is a disk affixed to an outer surface of said first leg of said housing, so that said disk can be grasped by gingers on a hand of the person and an edge of said disk used to scrape off the coating on the lottery ticket; and e) a transparent display pocket affixed to said disk; and a good luck medal, which can be inserted into the transparent display pocket, so as to make the person feel lucky.

9. A scraper and brush device for a lottery ticket as recited in claim 8, wherein said cleaning means is a brush fixed to an outer surface of said second leg of said housing, so that said first leg with said scraping means can be grasped by fingers of a hand of the person and said brush used to remove the scraped coating off the lottery ticket.

10. A scraper and brush device for a lottery ticket as recited in claim 9, wherein said brush includes two rows of bristles arranged in groups and embedded into the outer surface of said second leg of said housing.

11. A scraper and brush device for a lottery ticket as recited in claim 10, wherein said carrying means includes:

a) said body member having an aperture therethrough; and b) a slip ring extending through said aperture in said body member.

12. A scraper and brush device for a lottery ticket as recited in claim 11, wherein said carrying means further includes a bracelet connected to said slip ring, so that said bracelet with said device can be worn about a wrist on a hand of the person.

13. A scraper and brush device for a lottery ticket as recited in claim 11, wherein said carrying means further includes a necklace connected to said slip ring, so that said necklace with said device can be worn about a neck of the person.

* * * * *